United States Patent [19]

Sundberg

[11] 3,947,233

[45] Mar. 30, 1976

[54] FREE-BURNING EQUIPMENT

[75] Inventor: Carl Axel Sundberg, Kallhall, Sweden

[73] Assignee: C. A. Sundberg AB, Kallhall, Sweden

[22] Filed: Nov. 23, 1973

[21] Appl. No.: 418,274

Related U.S. Application Data

[63] Continuation-in-part of Ser. No. 246,871, April 24, 1972, abandoned.

[30] Foreign Application Priority Data

Apr. 26, 1971 Sweden ..... 5346/71
Nov. 29, 1971 Sweden ..... 15265/71

[52] U.S. Cl. ..... 431/328
[51] Int. Cl.[2] ..... F23D 13/12
[58] Field of Search ..... 431/328, 329

[56] References Cited

UNITED STATES PATENTS

| | | | |
|---|---|---|---|
| 1,830,826 | 11/1931 | Cox | 431/328 |
| 2,194,208 | 3/1940 | Moran | 431/328 |
| 2,528,738 | 11/1950 | Calkins et al. | 431/328 |
| 3,119,439 | 1/1964 | Weiss | 431/328 |
| 3,173,470 | 3/1965 | Wright | 431/328 |
| 3,191,659 | 6/1965 | Weiss | 431/328 |
| 3,531,229 | 9/1970 | Berlund | 431/328 |
| 3,672,839 | 6/1972 | Moore | 431/328 |
| 3,733,164 | 5/1973 | Westlake et al. | 431/328 |

*Primary Examiner*—Carroll B. Dority, Jr.
*Attorney, Agent, or Firm*—Hane, Baxley & Spiecens

[57] ABSTRACT

There is disclosed a free-burning equipment for gaseous fuel which comprises a burner member or filter into which fuel is fed under pressure by a feed pipe. The burner member is suitably shaped such as a flat plate which includes a multitude of narrow channels for the passage of fuel therethrough. The fuel is mixed as it turbulently emerges from the outside of the burner member, and is later ignited. A multitude of flames will thus, due to the gas pressure, burn well away from the burner head surface permitting said burner head surface to remain cold during so-called "free-burning."

19 Claims, 7 Drawing Figures

FIG. 4
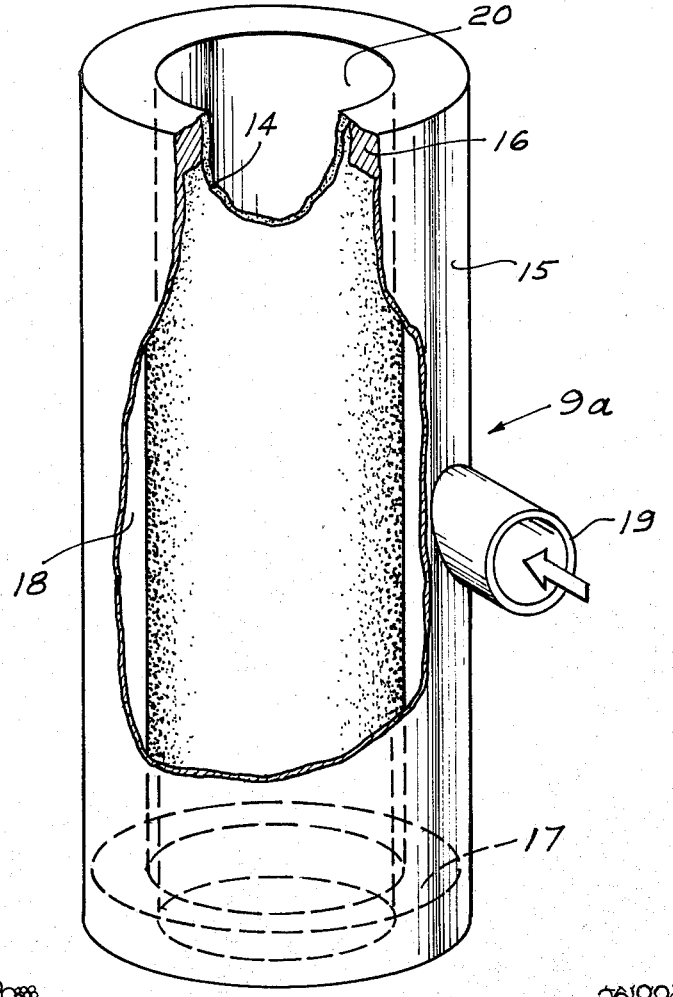
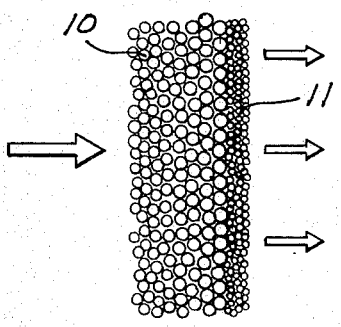
FIG. 5
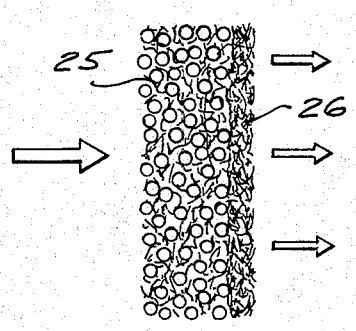
FIG. 6

FREE-BURNING EQUIPMENT

This application is a continuation-in-part application based on application Ser. No. 246,871 filed Apr. 24, 1972 and now abandoned.

The present invention relates to free-burning equipment for gaseous fuel with admixture of air and more particularly, to burner heads of a type which permits so-called "free-burning" and when used for industrial heating purposes is capable of a specific heat generation that is approximately hundredfold that of conventional burners of infratype.

There are known burners of different types e.g. athmospheric burners and fan burners. The former receives gas at a pressure greater than athmospheric pressure which gas is passed through a nozzle where it sucks air along before it passes through a combustion pipe and is ignited and absorbing secondary air from environment. Thus one gets the so called "Bunsenflame" with relatively low temperatures.

The most common type of industrial Bunsenburners are the so called infraburners, which utilize porous ceramic materials where the gas burns at the surface of the ceramic filter, the temperature of which reaches approx. 1000°C suitable to obtain infra-radiation. Due to the poor heat conducting properties of the ceramic material the interior temperature of the filter plate is limited to only approx. 200° C, preventing the gas-air mixture in the mixing chambers from igniting.

In the patent literature there is disclosed (e.g. U.S. Pat. No. 2.528.738) methods of using sintered metal for infra-burner filters where the combustion takes place on the surface of burner face. This is, however, no improvement since the metal is consumed at the high temperatures involved an also on account of the high heat conductivity of the metal raising the interior temperatures to a level where the gas-air mixture in the mixing chambers is definately ignited. The surface load of an infraburner is comparatively low in the neighbourhood of 12 koal/cm². h.

Among the latter type of burners, the fan burners, one may distinguish between two types:

Firstly, those with pre-mixing of gas and air and secondly those where the mixing of gas and air does not take place until gas and air has been fed into the burner where gas and air mix at the end of respective feedpipe, so called nozzle mixing. Burners with nozzle mixing are the most common industrial burners but have the disadvantage of giving incomplete mixing with resulting poor combustion and comparatively high fuel consumtion in addition to the disadvantage of long flames. The latter property resulting in the necessity of specially designed furnaces to enable the flame to completely burn out before hitting the material to be treated.

With the type of burner disclosed by the present invention a pre-mixed gas-air mixture at sufficiently high pressure is used, such that a so called "free-burning" flame appears i. a. a flame which is positioned outside of the burner plate but which in spite of this is stable and difficult to blow out. On account of the low mechanical strength of ceramic materials and the difficulty of tightly attaching this material to metal mixing chambers it is not possible to obtain a "free-burning" flame with known ceramic filter designs.

An attempt to solve this problem is disclosed by the U.S. Pat. No. 3,199,944 where a sheet of asbestos is used.

However, asbestos sheets are comparatively fragile, hence support means, usually metal nettings must be provided thereby correspondingly increasing the total costs of the burner. Another disadvantage of burners of this kind is that the useful life of asbestos sheets is rather short. The initially very narrow channels therein are fairly rapidly destroyed by erosion; it has been found that they either become clogged or too wide. Moreover, the flame on the outside of the sheet when the burner is used tends to destroy the supporting metal netting after a comparatively short time, and such destruction of the netting causes collapse or falling out of the sheet.

In order to obtain a stable burner flame it is necessary that the exit velocity of the outflowing gas mixture equals the ignition velocity. Should the exit velocity increase the flame will lift away from the burner face and with decreased exit velocity the flame may backfire. Through tests it has been found that increased turbulence results in increased ignition velocity and thus in a possibility of increasing the load (kcal/cm². h.) Increased turbulence also results in more stable and shorter flames with higher flame temperatures. These circumstances are utilized in certain types of fan burners which are provided with different types of guide devices to increase turbulence. Further it is also shown that the ignition velocity of the gas increases with temperature causing the flame to creap closer to the burner face should the gas be heated up during the passage through the filter.

The present invention discloses a burner of sintered metal yielding:

- a strong turbulence of gas-air mixture,
- a stable "free-burning" flame,
- a burner operating in cold condition,
- a burner able to withstand surface loads of up to 1000 kcal/cm².h,
- a burner able to operate with considerably higher pressures than hitherto known burners and
- a burner which is positively backfire proof.

Finally it is also known to provide sintered ceramic or metal filters formed by particles of different shape (globular, fibre etc.). All these burners are so called infra-burners, where the flames are in direct contact with the filter surface. The all overshadowing problem with this prior art has been to find suitable porous materials able to withstand the high temperatures generated by infra-burning but yeat retaining its mechanical strength.

On account of the high temperatures generated it is desirable to use ceramic materials with low expansion coefficients. This material is, however, brittle and is easily developing heatcracks. It is also feasable to use metals of various types and shapes but serious problems arise here as well due to heat expansion.

Above described problems are obviously accentuated if one wishes to increase heat generation by higher fuel pressure and thereby increased mechanical stresses. The high temperatures often softens the material prohibiting high surface loads. Only low gas pressure surface loads may therefore be permitted which limits the fuelflow and possible heat generation thus completing a vicious circle.

In known sintered or drilled burners of the ceramic type the gas mixture pressure used is comparetively low and the burners are always of the atmospheric type which means that gas under pressure passes a nozzle sucking air along towards the filter. (The so called above referred to Bunsen method, which is possible only when the burner plate has a very low resistance to facilitate gas and air passage. Should the resistance be too high the gas will not suck the air along and the air will instead leave the very holes, which are intended for air entrance).

In the case of a sintered metal filter of porosity 50% the pressure decrease is averaging 150 mm WH/mm filter thickness operating at a heat generation level of 1000 kcal/cm$^2$.h. Thus a gas pressure of at least 450 mm WH is required to drive a filter of a thickness of 3mm.

However, in order to obtain the effect of "free-burning" a gas mixture pressure of up to 2000 mm (Water Head) is required. It is at present not technically possible to make a ceramic filter of said thickness (3 mm) and porosity of 40–60% that is able to withstand such a gas pressure, and if the thickness is increased in order to increase the mechanical strength gas pressure must be correspondingly increased to maintain the gasflow velocity.

When sintered metal is used in the prior art it has been applied in the same way as the above described ceramic filter. This is, however, no technical improvement and perhaps the contrary, due to the fact that metal is more rapidly consumed by the surface burning flames, than is ceramic materials. Additional problems are also encountered on account of the thermal expansion of the metal if not spec. counter-measures are used.

The present type of burner head is perhaps more appropriately referred to as a gas-air mixer operating at fairly high pressures. So called fan burners are normally used when high heat generation is required, which burners usually mix air and gas near the opening of the burner pipe resulting in poor mixing unless costly mixing devices are utilized. The present burner is normally supplied with pressurized gas-air mixture by means of a fan and the superior mixing results in a more complete combustion throughout the entire regulation range. Normal fan air pressure is approx. 1500 mm WH while the fan gas pressure is approx. 1000 mm WH when a stainless steel filter of approx. 50% porosity with particle sizes of approx. 75 $\mu$ is used. This is not the case with conventional burners, the efficiency of which varies between 30–70% depending on the operating point within the regulation range.

The good fuel mixing of the present burner results in an extremly clean combustion with considerable savings in fuel consumtion and costs.

The audio noice level is due to the small flames strongly reduced. For a large burner of iron-work purposes which is burning 4 kg gas/h the noice level is only 70 dba at a distance of 100 cm. Hence no audio noice level attenuation facilities are required.

To sum up, the so called "free-burning" mode of operation being the basic idea of the present invention, prevents by means by turbulent jets of different directions the gas mixture from igniting until it is well outside (1–10 mm) of the filter surface the temperature of which remains low. The cooling in fact being so effective that backward radiation of heat is not at all noticible and one may put one's hand on the filter immediately after shut down.

The "free-burning" idea disclosed by the present invention offers a multitude of advantages over the conventional infra-burning technique e.g.

1. More efficient turbulence fuel mixing.

2. Cold filter operation.
3. Cleaner combustion.
4. Long useful filter life.
5. Higher temperatures may be reached.
6. Heat generation relative filter area is increased approx. hundred-fold.
7. Lower fuel costs with increased efficiency.
8. Lower operating noice levels.
9. Large burner areas possible.
10. Greater freedom of design with respect to shape and form.

THE INVENTION

It is a broad object of the invention to provide a novel and improved burner for gaseous fuel, the burner member of which is free of the aforepointed out shortcomings of the now known burner member in that it is not using the method of infra-burning but that of "free-burning", the implication of which is that the burner head filter generates a great multitude of turbulent gas jets of random directions thus accomplishing a very efficient fuel (gas and air) mixing zone above which ignition takes place. Due to the continuous cooling effect of new cool gasmixture continually passing through the filter at a fairly high speed and pressure the cooling will be very effective resulting in a long useful filter life and rendering the filter less expensive to manufacture.

A more specific objet of the invention is to provide a novel and improved burner of a new kind above referred to, the burner member of which is made of a porous sheet of metal thereby obtaining the advantages of perforated metal sheets as to durability and mechanical strength and which is able to withstand high gas mixture pressures required to obtain necessary turbulence for "free-burning"

Another more specific object of the invention is to provide a novel and improved burner of the new kind above referred to, the burner member of which has all the advantages of a perforated metal sheet as now known but operating with "free-burning", where the extremly efficient mixing results in comparatively short and stable flames of high temperature thus increasing flame velocity and thereby possible maximum heat generation. (approx. 100 times that of infra-burners). This results also in elimination of any danger of backfiring of the flame.

Another object of the invention is to facilitate construction of large burner areas, where the only limitation is the production of sufficiently large filters with even porosity. In the case of bronze this limitation is today approx. 3000 cm$^2$ corresponding to a capacity of 3 million kcal/h.

This feature enables e.g. construction of smaller ovens for metallurgical industry by the use of shorter flames.

SUMMARY OF THE INVENTION

The aforepointed out objects, features and advantages, and other objects, features and advantages which will be pointed out hereinafter are obtained by providing as burner member a porous metal sheet including flow channels which are more or less irregular and particularly not straight as to produce a multitude of randomly directed gas jets of such velocity that when ignited they result in short flames at a distance from burner member surface, so called "free-burning".

Tests have shown that a porous metal sheet according to the invention also has good cooling action and a practically unlimited useful life, thus eliminating all problems with mechanical strength.

To obtain a short and stable flame an extremly good mixing of gas and air is required which in the present case is obtained by strong turbulence caused by curling gas jets directed in random directions by the arbitrary openings of the sintered metal filter, the main object of which is to effect the mixing function. In comparable burners the mixing usually takes place near the burner pipe opening resulting in incomplete mixing and long flames with resulting lower temperatures.

According to another aspect of the invention, the width of the channels in the metal sheet decreases from the side of the member to which the fuel is fed toward the sheet side at which the fuel emerging from the sheet is ignited. De crease of the width of the channels may be gradual or stepwise. The porous metal sheet may be in one piece or composed of superimposed layers within which the width of the channels may change from layer to layer.

According to another aspect of the invention metals such as bronze are used as filter material. Metals of low melting point may of course never be used with infra-burners.

The burner member may be in the form of a flat plate, it may be dome-shaped or sperical or cylindrical. Various other configurations of the burner member may also be suitable. When the burner member is cylindrically shaped, the fuel may be fed to the burner from the inside of the burner member or from the outside. In the first case, the fuel will pass into the cylindrical member, in the second case it will flow out of the same. In either case ignition of the fuel is effected on the side on which the fuel emerges from the sheet. A feeding of the fuel to the burner member to a cylindrical burner member from the outside thereof is particularly suitable when, for instance, shafts are to be heated.

DETAILED DESCRIPTION OF THE INVENTION

In the accompanying drawing, several embodiments of the invention are shown by way of illustration and not by way of limitation.

IN THE DRAWING

FIG. 4 is an elevational view, partly in section, of a cylindrical burner member according to the invention;

FIG. 5 is a fragmentary view of a burner member composed of several layers;

FIG. 6 is a fragmentary view of a modification of a burner member composed of several layers.

Figure 1:
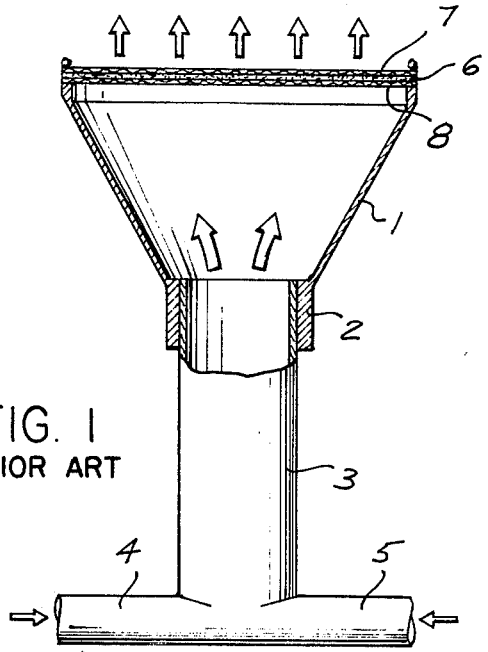
FIG. 1 PRIOR ART
FIG. 1 is an elevational, partly sectional view of a prior art burner.

Referring now to the figures in greater detail, the Prior Art infra-burner according to FIG. 1 comprises a generally conical holder 1, the bottom of which is supported by a ring-shaped member 2, which in turn is secured to an upright hollow stand 3. This stand communicates with feed pipes 4 and 5. Pipe 4 may be visualized as a feed pipe for supplying air to the stand and pipe 5 as supplying gaseous fuel. The air and the fuel are mixed in stand 3 and this mixture passes through a porous asbestos sheet 6 which is sandwiched between wire netting 7 and 8. As previously explained, such wire netting is required to prevent a collapse of the inherently rather fragile asbestos sheet. The gas is ignited by any suitable means as it emerges on the top side of the asbestos sheet.

Figure 2:
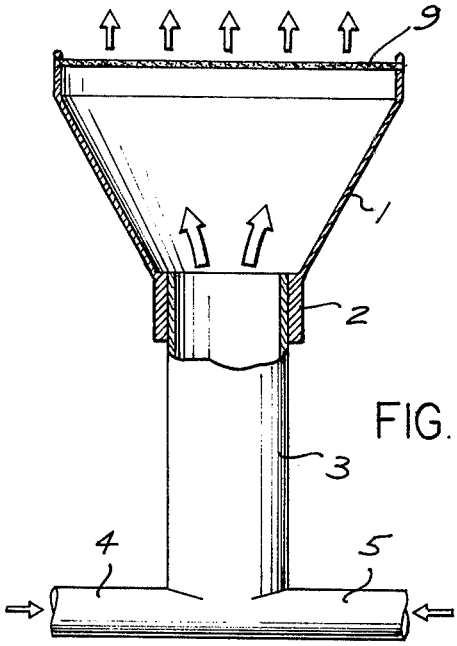
FIG. 2 is an elevational, partly sectional view of a burner according to the invention, the burner of FIG. 2 being similar to the burner of FIG. 1 except for the burner member at the top of the burner.

Turning now to FIG. 2, the burner as shown in this figure is similar to that of FIG. 1, except that the burner member 6, 7 and 8 is replaced by a burner member 9 in the form of a porous metal plate. Feed pipe 4 is thus supplying pressurized air from fan or compressor, and pipe 5 compressed gaseous fuel with overall pressure $\geq$ 100 mm WH. Such porous metal includes inherently a multitude of irregular channels that may have various shapes, but are generally not straight. Metals suitable for the purpose are, for instance, steel and bronze.

Figure 3:
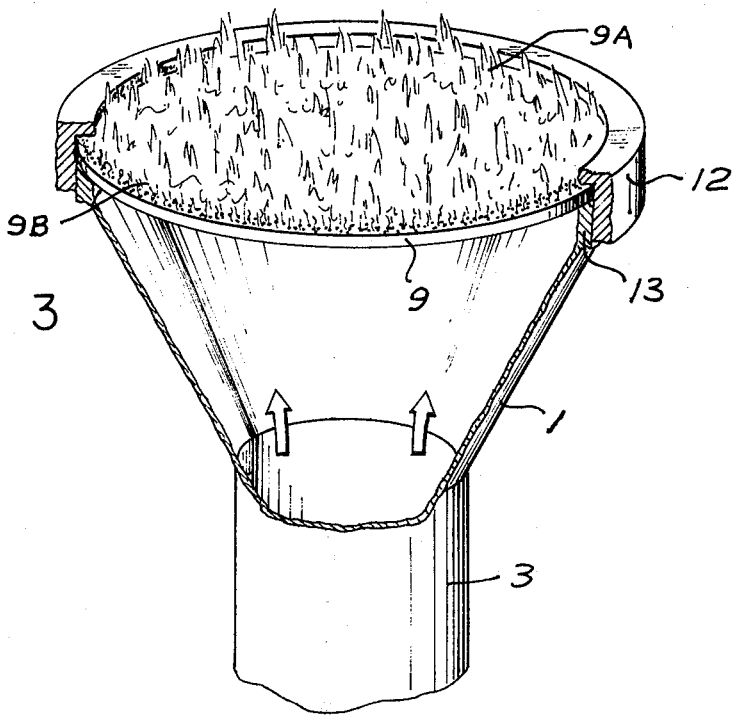
FIG. 3 is an elevational, partly sectional view showing the burner member of FIG. 2 in detail andon an enlarged scale.

A porous metal sheet suitable for the purpose of the invention can be conveniently produced by sintering together metal particles. These particles may be in the form of small spheres or irregular bodies, they may also be in the form of short metal threads. As it is evident, a sheet consisting of sintered-together small spheres or otherwise shaped metal particles includes a multitude of interstices constituting small irregularly shaped channels permitting on one hand a flow of gaseous fuel therethrough to establish free-burning as shown in FIG. 3 where the flames (9A) are spaced from the filter face (9) by a mixing zone (9B) and which on the other hand effectively preventing backfiring of the flame from the top side of the burner plate into conical holder 1 and even into the stand 3 where such backfiring may have dangerous consequences.

As it is shown in FIG. 5 the porous burner cover may be composed of superimposed layers 10 and 11; more than two layers may, of course, be used if desired.

It has been found advantageous to decrease the cross-sectional areas of the channels from the inside of the sheet toward the top side thereof. Such variations in the cross-section of the channels can be conveniently obtained by decreasing the particle sizes from the inner side of the outer side of the burner plate. If the plate is composed of several layers, the layer made of the largest particles and thus having the widest channels may be the bottom layer and the layer including the smallest particles and thus the narrowest channels is used as top layer. The layers may be simply stacked one upon the other or they may be bonded together by any one of the many metallurgical methods known for such purpose.

Reverting to FIG. 5, layer 10 is the inner layer. As is clearly shown, comparatively small spheres are used in this layer and layer 11 is the outer or top layer and the spheres used for that layer are correspondingly smaller.

FIG. 6 shows a burner plate in which the thick layer 25 is composed of a mixture of metal spheres and metal threads while the thin layer 26 is composed of short metal threads only. Of course, layer 26 may also include metal spheres and conversely, layer 25 may consist of threads only.

The spheres used in layer 10 may be selected so that the channels have a diameter of 100 $\mu$ and the particles used in layer 11 have a size such that the channels have a diameter of about 20 $\mu$. The threads in the layers 25 and 26 in FIG. 6 may be correspondingly varied in thickness.

As it is now evident, any desired cross-sectional areas in the channels may be obtained by suitably selecting the sizes of the particles of which the burner plate 9 is composed. As it is also evident, the superimposed layers of which the cover is composed may be given different thicknesses. For instance, the layer including the widest channels may have a thickness of approximately 3 mm and the layer including the narrowest channels may have a thickness between 0.1 mm and 1 mm (see FIGS. 5 and 6).

Reverting to FIG. 3, the burner member 9 of this figure is secured by two rings 12 and 13 at the upper edge of conical holder 1. As previously explained, the channels formed in a porous burner member are inherently irregular and in particular rarely straight thereby effectively preventing backfiring of a flame burning above the top side of member 9. As it is indicated, a great number of intense flames of comparatively short length such as about 10 mm can be readily obtained. This has the advantage that an object to be heated can be placed without danger of damage very close to the burner thus making it unnecessary to heat the object further by secondary heat radiated from the wall of the burner.

It is further found that when the flame in the burner according to FIG. 3 is estinguished, the heat of member 9 decreases very rapidly to a level at which the member can be safely touched due to the high cooling efficiency obtained by the presence of the multitude of channels.

According to FIG. 4, the burner member 9*a* comprises a porous metal tubular member 14 which is arranged coaxially within an outer shell 15, which has at its upper and lower ends inwardly extending peripheral flanges 16 and 17, respectively, defining a narrow annular space 18 within the shell. A feed pipe 19 secured to shell 15 communicates with this space for pressure feeding fuel gas, either with or without an admixture of air, into said space. The fuel flows from space 18 through the channels in member 14 into the inner space 20 defined by porous member 14 and is ignited within space 20. Accordingly, cylindrical objects such as shafts are conveniently and uniformly heated on their entire outer wall surface when place within space 20.

As it is obvious, the burner according to FIG. 4 can be readily so arranged that fuel is fed into the space 20. It will then flow through the porous wall of member 14 into the space 18, where it is ignited. Of course, with such arrangement the space 20 would have to be completely closed.

Figure 7:
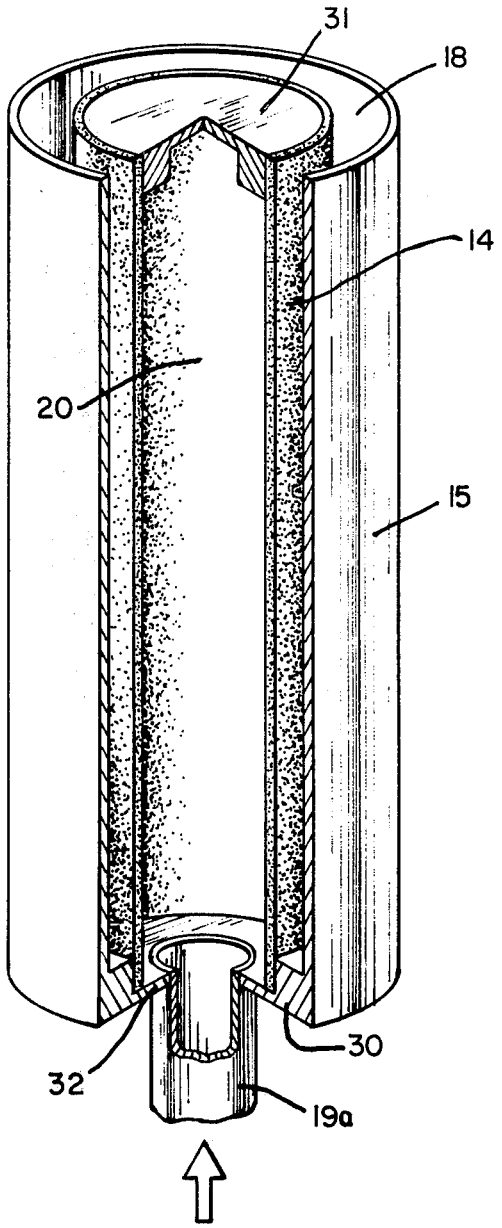
FIG. 7 is an elevational view, partly in section, of a modification of the cylindrical burner member shown in FIG. 4.

FIG. 7 illustrates a burner arrangement as just described. According to this figure, the annular space 18 as defined by inner porous shell 14 and solid outer shell 15 is left open at one end but may be closed at the other end by a wall 30. The space 20 as defined by the porous inner shell is closed at both ends by closure members 31 and 32. The gaseous fuel is fed into space 20 by a pipe 19*a*. The gaseous fuel which as described is fed under pressure, with or without the admixture of air; flows through the channels in shell 14 and is ignited after it emerges from the wall, that is, within space 18. Members such as cylindrical tubular members to be heated or otherwise processed are inserted into this space 18.

The wall of shell 14 may be constructed as previously described, for instance in the mannershown in FIGS. 5 and 6. As indicated before, the burner member may be also spherical; or dome-shaped, generally speaking, any desired shape can be selected for the burner member provided only that it directs the flow of gas and thus the direction of the flame in a manner such that the flame is suitable for heating a selected object.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A burner equipment for burning gaseous fuel, said burner equipment comprising in combination:
   a burner stand defining an open space therein;
   feed means for feeding a pressurized mixture of gaseous fuel and air into said space; and
   a burner member closing said space, said burner member having an outside surface and an inside surface, the latter being in communication with said space the burner member consisting of sintered-together metal particles, the interstices between the particles defining a multitude of channels in random distribution and forming passages for a flow of pressurized gaseous fuel and air mixture through the burner member from the inside to the outside surface thereof, said burner member being composed of superimposed layers, the cross-sectional widths of the channels being different in different ones of said layers, the narrowest channels being in the outermost layer, the channels in the layer including the widest channels having a width of about 100 $\mu$ and the channels in the layer including the narrowest channels having a width of about 20 $\mu$, the layer including the widest channels having a thickness of about 3 mm and the layer including the narrowest channels having a thickness between about 0.1 mm and 1 mm, the flow of the gaseous fuel and air mixtures forming a turbulent zone at the outside surface of the burner member, said zone constituting an insulation layer above the outside surface of the burner member preventing contact of a flame with the outside surface of said burner member and forcing the flame to burn free of the burner member upon ignition of the emerging flow of gaseous fuel and air mixture thereby maintaining the burner member at cool operational condition.

2. The burner according to claim 1 wherein said burner member is a flat plate.

3. The burner according to claim 1 wherein said burner member is a tubular member.

4. The burner according to claim 3 wherein the gaseous fuel is fed to said tubular member from the inside thereof.

5. The burner according to claim 3 wherein the gaseous fuel is fed to said tubular burner member from the outside thereof.

6. The burner according to claim 1 wherein said metal particles are made of stainless steel.

7. The burner according to claim 1 wherein said metal particles are made of bronze.

8. The burner according to claim 1 wherein said metal particles are in the form of spheres.

9. The burner according to claim 1 wherein said particles are in the form of threads.

10. The burner according to claim 1 wherein said stand is a hollow tubular stand open at one end, said burner member covering said open end.

11. The burner according to claim 1 wherein said burner stand comprises an outer shell and an inner shell disposed in coaxial and radially spaced apart relationship to define an annular space therebetween, the wall of the inner shell including said multitude of channels, cover means closing said annular space at both ends, said feed means feeding the gaseous fuel into said closed annular space.

12. The burner according to claim 1 wherein said burner stand comprises an outer shell and an inner shell disposed in coaxial and radially spaced apart relationship to define an annular space therebetween, the wall of the inner shell including said multitude of channels, cover means closing the space within the inner shell at both ends thereof, said feed means feeding the gaseous fuel into said closed inner space within the inner shell through the cover means at one end of the inner shell.

13. A burner for gaseous fuel comprising:

a hollow burner stand;

a feed pipe for pressure feeding gaseous fuel into said stand; and a burner member covering an open end of said stand, said burner member including a multitude of channels for the passage of the gaseous fuel under pressure from the stand through the burner member directed upon the inner side thereof for ignition of the fuel on the outside of said member, said burner member being composed of a multitude of sintered-together metal particles, the interstices between said particles forming said channels, said particles being disposed in superimposed layers, the cross-sectional widths of the channels being different in different ones of said layers, the narrowest channels being in the outermost layer, the channels in the layer including the widest channels having a width of about 20 $\mu$, the layer including the widest channels having a thickness of about 3 mm and the layer including the narrowest channels having a thickness between about 0.1 mm and 1 mm.

14. The burner according to claim 13 wherein said multitude of channels include channels having a configuration other than a straight configuration.

15. The burner according to claim 13 wherein said burner member is a flat plate.

16. The burner according to claim 13 wherein said metal particles are made of stainless steel.

17. The burner according to claim 13 wherein said metal particles are made of bronze.

18. The burner according to claim 13 wherein said metal particles are in the form of spheres.

19. The burner according to claim 13 wherein said particles are in the form of threads.

* * * * *